US008398323B2

(12) United States Patent
Kotturan

(10) Patent No.: US 8,398,323 B2
(45) Date of Patent: Mar. 19, 2013

(54) DENTAL APPLIANCE

(76) Inventor: Paul Kotturan, Deerfield Beach, FL (US)

( * ) Notice: Subject to any disclaimer, the term of this patent is extended or adjusted under 35 U.S.C. 154(b) by 317 days.

(21) Appl. No.: 12/858,973

(22) Filed: Aug. 18, 2010

(65) Prior Publication Data

US 2012/0045733 A1 Feb. 23, 2012

(51) Int. Cl.
*A46B 5/02* (2006.01)

(52) U.S. Cl. ..... 401/8; 401/6

(58) Field of Classification Search ..... 401/6–8; 15/104.94, 167.1, 227; 132/309; 433/143
See application file for complete search history.

(56) References Cited

U.S. PATENT DOCUMENTS

| | | | | |
|---|---|---|---|---|
| 1,200,596 | A * | 10/1916 | Daly | 15/227 |
| 2,075,681 | A * | 3/1937 | Welker | 401/7 |
| 2,883,691 | A * | 4/1959 | Gruenwald | 15/167.1 |
| 3,105,260 | A * | 10/1963 | Smith et al. | 15/167.1 |
| 3,368,668 | A * | 2/1968 | Micciche | 206/229 |
| 4,620,528 | A * | 11/1986 | Arraval | 601/162 |
| 5,875,513 | A * | 3/1999 | Reinold | 15/227 |
| 6,112,356 | A * | 9/2000 | Hashey | 15/104.94 |
| 6,116,252 | A * | 9/2000 | Stelmach | 132/309 |
| 6,874,194 | B1 * | 4/2005 | Harris | 15/227 |
| 7,127,771 | B2 * | 10/2006 | McDevitt et al. | 15/227 |
| 2005/0016561 | A1 * | 1/2005 | Sexson | 132/309 |
| 2005/0260536 | A1 * | 11/2005 | Costaras et al. | 433/26 |
| 2007/0022552 | A1 * | 2/2007 | Scheepers | 15/167.1 |

FOREIGN PATENT DOCUMENTS

FR 2600872 A1 * 1/1988

OTHER PUBLICATIONS

Finger Brush online brochure —available since at least 1997 by Convenience Packaging Inc. of St. Louis, Mo. http://fingerbrush.net.
Brushing Teeth Made Easy—Finger-Brush by Convenience Packaging Inc. Copyright 1995.
Twin Pouch Packaging—brochure dated Mar. 13, 1996 by Convenience Packaging Inc.

* cited by examiner

*Primary Examiner* — David Walczak
*Assistant Examiner* — Jennifer C Chiang
(74) *Attorney, Agent, or Firm* — Robert C. Kain, Jr.

(57) ABSTRACT

The dental appliance includes a pouch for an index finger with a dentifrice carrying pad. The pouch covers the index finger to at least a midsection region. The dentifrice pad is atop the user's finger pad surface. The pouch has an elongated tail which extends proximally to at least beyond the thumb of the user. The tail has one or many thumb holes, located at a proximal region, and the user, upon insertion of his or her finger in the pouch, pulls the tail and insert his or her thumb in the thumb hole. Therefore, the thumb hole is adapted to encircle the thumb of the user when the pouch is mounted on the user's index finger. The tail may be elastic. The dentifrice pad (with dry powder) sometimes includes bumps or ridges. Alternatively, the tail may be long to wrap around the wrist of the user.

14 Claims, 2 Drawing Sheets

DENTAL APPLIANCE

The present invention relates to a dental appliance consisting of a pouch with a tooth cleaning pad which is removably mounted on an index finger of a user wherein the dental appliance has an attachment tail.

BACKGROUND OF THE INVENTION

It is sometimes necessary to clean teeth without the assistance of bathroom facilities or a sink. One prior art device, called FINGER-BRUSH by Convenience Packing Inc. of St. Louis, Mo., is a finger pouch wherein the user inserts his or her finger into a cavity formed by two sheets of material. At a distal end of one of the sheets is powder dentifrice. Also, the package has an elongated extension which the user holds with the remaining fingers of his or her hand.

A problem associated with the prior art device is that the user's hand becomes cramped or the finger pouch is not secured on and along the index finger of the user.

OBJECTS OF THE INVENTION

It is an object of the present invention to provide a dental appliance wherein the pouch for the index finger is connected to an elongated tail and the tail is mounted on a wrist or thumb thereby tightly securing the finger pouch on the index finger of the user.

It is another object of the invention to provide a dental appliance to massage the interior portions of the user's mouth and cheeks and, potentially, to massage the user's gums.

SUMMARY OF THE INVENTION

The dental appliance in accordance with the principles of the present invention, in one embodiment, includes a pouch adapted to be placed on an index finger of a hand of a user. The pouch covers a portion of the index finger at least at a mid-section region between a proximal interphalangeal joint (PIP) and a distal interphalangeal joint (DIP). The user's finger has a finger pad surface opposite the fingernail surface. The pouch has a dentifrice carrying pad outboard of the finger pad surface of said user's finger. The pouch is elongated and is sized to capture and cover the user's finger from its distal portion to at least a finger midsection. Longer pouches covering substantially all of the index finger may be provided. These longer pouches or finger coverings may be useful when a health worker is cleaning a patient's teeth thereby providing greater hygienic protection to the health worker.

The pouch has an elongated tail, either integral with the pouch material or as an attached element. The tail extends from a proximal end of the pouch and further extends at least beyond the thumb of the user. The tail has a thumb hole at a proximal region which thumb hole is adapted to encircle the thumb of the user when the pouch is mounted on the user's index finger. The tail has one or many thumb holes, located at a proximal region, and the user, upon insertion of his or her finger in the pouch, pulls the tail and insert his or her thumb in the thumb hole. Therefore, the thumb hole is adapted to encircle the thumb of the user when the pouch is mounted on the user's index finger. In one embodiment, the tail is an elastic material. The dentifrice pad sometimes includes a plurality of bumps or ridges. The dentifrice is typically a dry powder. Multiple thumb holes may be used and the pouch may have indicia or markings for properly mounting the appliance on the hand of the user. Alternatively, the tail is long and can be wrapped around the wrist of the user and then secured to the thumb.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to a dental appliance with a finger pouch and an elongated tail to securely mount the pouch on the index finger of a user wherein the tail encircles or attaches to a thumb to secure the pouch on the finger. Similar numerals designate similar items throughout the drawings.

Figures 1, 2:
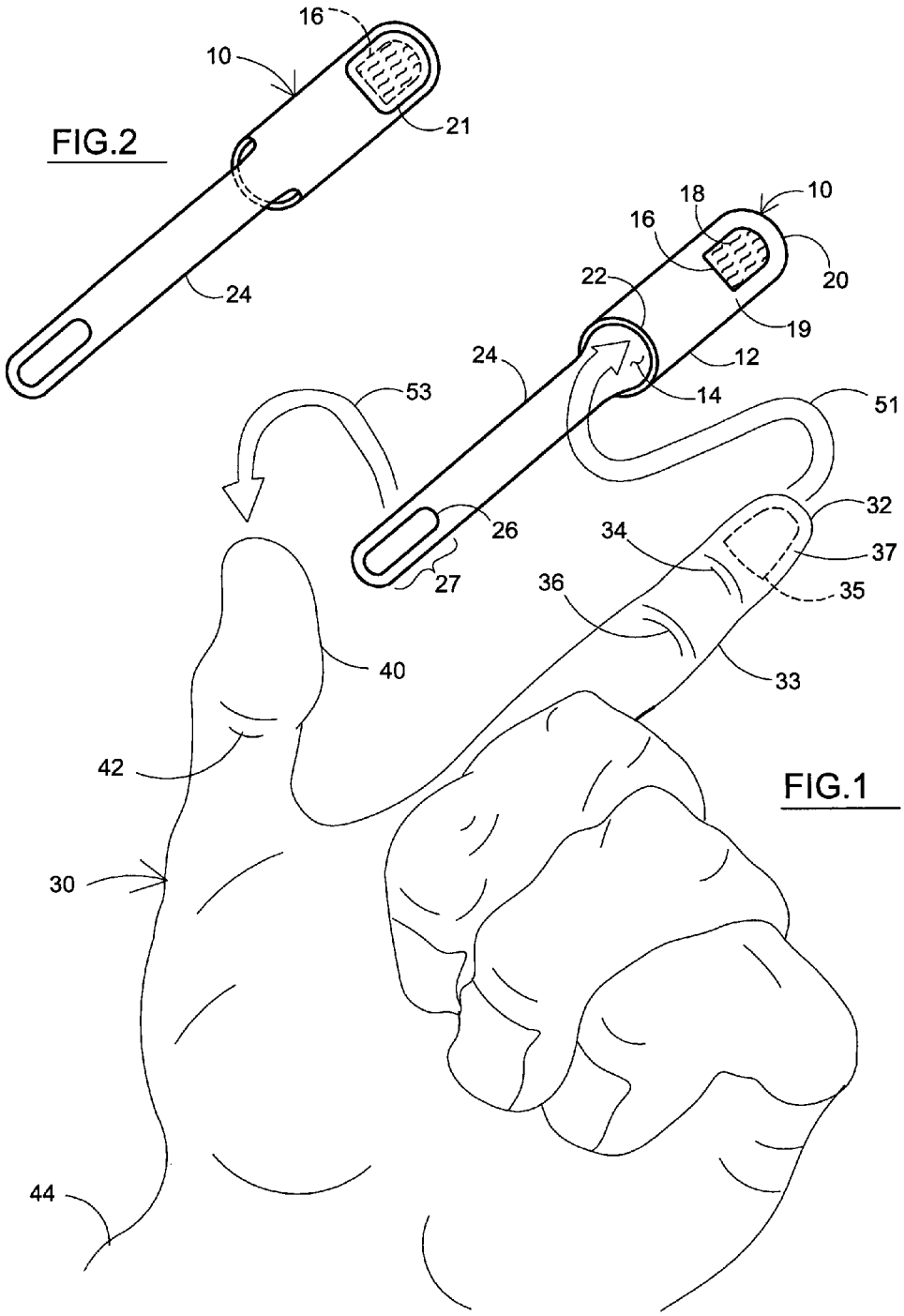
FIG. 1 diagrammatically illustrates the dental appliance and portions of a user's index finger, hand, wrist and thumb.
FIG. 2 diagrammatically illustrates a rear view of the dental appliance (the dentifrice pad shown in dashed lines)

FIG. 1 diagrammatically illustrates dental appliance 10 having a finger pouch 12. Pouch 12 defines an opening 14 at a proximal end 22 of pouch 12. The distal end 20 of pouch 12 is opposite proximal end 22. A pad 16 is mounted or formed or defined on an outboard surface of pouch 12 and dentifrice 18, typically in a powder form, is disposed on pad 16.

A tail 24 is attached to proximal end 22 of pouch 12. The tail extends well beyond proximal end 22 of pouch 12. Tail 24 includes a thumb hole 26 at a proximal region 27 of tail 24.

As described earlier, finger pouch 12 is placed on the index finger 33 of user hand 30. Index finger 33 has a distal end 32 and a fingernail 35 opposite the finger pad 37. In FIG. 1, fingernail 35 is in shadow lines and the perspective is a front view of finger pad 37. Index finger 33 includes a DIP joint 34 and a PIP joint 36. Hand 30 also includes thumb 40 with a thumb joint 42. Hand 30 also includes wrist 44. Only a portion of hand 30 is shown in FIG. 1.

In operation, index finger 33 is inserted in opening 14 as shown by arrow 51. The user pulls pouch 12 onto index finger 33 such that at least most of the index finger 33 is covered by the pouch. The pad 16 is atop finger pad 37 on an outboard side of the pouch. Preferably, the pouch covers a distal portion of the user's finger extending from finger distal end 32 to at least a mid-section between DIP joint 34 and PIP joint 36. In some embodiments, the pouch extends proximally a greater distance on the index finger 33 beyond PIP joint 36. In order to maintain pouch 12 securely on index finger 33, tail 34 of dental appliance 10 is pulled and thumb 40 is inserted in thumb hole 26 of tail 24 as noted by arrow 53. In this manner, pouch 12 is fully secured on index finger 33 due to the tension between thumb 40 and thumb hole 26 by pulling, in a longitudinal manner, on tail 24 of the dental appliance.

FIG. 2 diagrammatically illustrates dental appliance 10 and shows that the dentifrice carrying pad 16 (shown in dashed lines) is typically on an opposite side of the pouch compared with the attachment point or region for tail 24. As noted in FIG. 1, dentifrice carrying pad 16 is on an outboard surface 19 of pouch 12 and that outboard surface is atop finger pad 37 of finger 33. In an alternative embodiment, the appliance pouch 12 has a massage pad 21 outboard of the pouch and over the opposite fingernail surface of the user's finger. In this alternate embodiment, the massage pad 21 carries additional dentifrice. Outboard surface 21 is shown in FIGS. 2 and 3.

Operationally, the massage pad 21 is used to massage the interior portions of the user's mouth and cheeks and may be used to massage the user's gums. The addition of the dentifrice on massage pad 21 enables the pouch to be used frontwards (pad 16 on the teeth) and backwards (massage-dentifrice pad 21 on the teeth).

Figure 3:
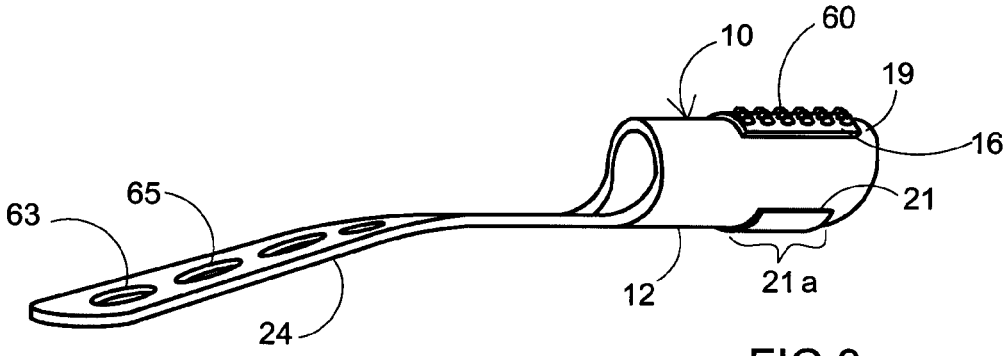
FIG. 3 diagrammatically illustrates a variation of the dental appliance wherein the dentifrice carrying pad includes a plurality of bumps or ridges.

FIG. 3 shows an alternate embodiment of dental appliance 10 wherein the dentifrice carrying pad 16 has a plurality of bumps or ridges or protrusions, one of which is protrusion 60, extending outboard beyond surface 19 of finger pouch 12. Further, FIG. 3 shows that tail 24 has a plurality of thumb holes 63, 65. In this manner, the dental appliance can be configured to be used on small hands as well as large hands. The user would select the appropriate thumb hole 63, 65 in order to properly mount dental appliance 10 on his or her index finger 33.

Figure 4:
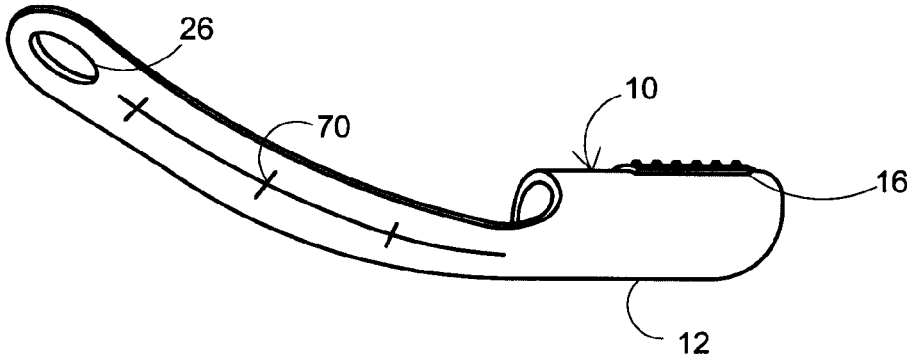
FIG. 4 diagrammatically illustrates a dental appliance with markings or indicia to properly mount the appliance on the index finger of the user.

FIG. 4 shows another embodiment of the present invention wherein both pouch 12 and tail 24 include indicia 70 configured as a line or markings interposed with plus signs. The indicia provides instruction to the user to align indicia line or marking line 70 longitudinally along the index finger of the user when the index finger points straight forward. In this manner, the user accurately places dentifrice carrying pad 16 at the proper location.

As is known in the prior art with the Convenience Packing FINGER-BRUSH, dentifrice carrying pad 16 should be atop finger pad 37 of index finger 33 in order for the user to clean his or her teeth. In the present invention, the marking indicia assists the user to properly mount the pouch on the finger. Also, the thumb hole attachment better secures the pouch on the hand and avoids cramping of fingers.

Figure 5:
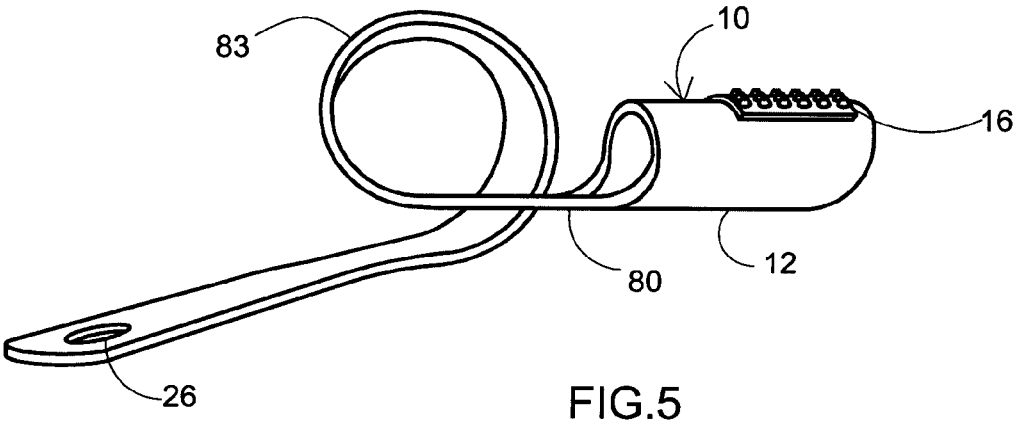
FIG. 5 diagrammatically illustrates an elongated tail such that the tail can be wrapped around the thumb or the wrist of the user.

FIG. 5 diagrammatically shows another embodiment of the present invention wherein dental appliance 10 has a very long tail 80. As shown, tail 80 is so long that it is capable of being wrapped or looped around either wrist 44 of hand 30 or wrapped multiple times around thumb 40. Loop region 83 designates this wrap around. Once tail 80 is wrapped around one or more times, thumb 40 is inserted into thumb hole 26 as noted by arrow 53 in FIG. 1.

The claims appended hereto are meant to cover modifications and changes within the scope and spirit of the present invention.

What is claimed is:

1. A dental appliance adapted to be placed on an index finger of a hand of a user, the index finger having a finger pad surface, an opposite fingernail surface, a proximal interphalangeal joint (PIP) and a distal interphalangeal joint (DIP) and said user's hand having a thumb, the dental appliance comprising:

a pouch sized to capture and cover a distal portion of the user's finger extending from a finger's distal end to at least a midsection between said distal interphalangeal joint and said proximal interphalangeal joint, said pouch having a dentifrice carrying pad outboard of said finger pad surface of said user's finger; and an elongated tail extending from a proximal end of said pouch and extending at least beyond said thumb of said user, said tail having a thumb hole at a proximal region which thumb hole is adapted to encircle said thumb of said user when said pouch is mounted on said user's index finger; and indicia on said pouch and said tail, said indicia aligned along said user's index finger when the index finger points straight forward to accurately place the dentifrice carrying pad at the proper location on the user's index finger when said pouch is properly mounted on said user's index finger and said thumb hole encircles said user's thumb.

2. A dental appliance as claimed in claim 1 wherein said tail is an elastic material.

3. A dental appliance as claimed in claim 1 wherein the dentifrice carrying pad defines a plurality of bumps or ridges and said dentifrice is dry powder.

4. A dental appliance as claimed in claim 1 wherein said elongated tail has a plurality of thumb holes to accommodate different sizes of user's hands.

5. A dental appliance as claimed in claim 2 wherein the dentifrice carrying pad defines a plurality of bumps or ridges.

6. A dental appliance as claimed in claim 1 wherein said pouch has a massage pad outboard of said opposite fingernail surface of said user's finger.

7. A dental appliance as claimed in claim 6 wherein said massage pad carries additional dentifrice.

8. A dental appliance adapted to be placed on an index finger of a hand of a user, the index finger having a finger pad surface, an opposite fingernail surface, a proximal interphalangeal joint (PIP) and a distal interphalangeal joint (DIP) and said user's hand having a thumb and a wrist, the dental appliance comprising:

a pouch sized to capture and cover a distal portion of the user's finger extending from a finger's distal end to at least a midsection between said distal interphalangeal joint and said proximal interphalangeal joint, said pouch having a dentifrice carrying pad outboard of said finger pad surface of said user's finger; and an elongated tail extending from a proximal end of said pouch and extending beyond said thumb of said user, said tail adapted to wrap around said thumb or a wrist of said user, and said tail having a thumb hole at a proximal region which thumb hole is adapted to encircle said thumb of said user when said tail is wrapped about said wrist or thumb and said pouch is mounted on said user's index finger; and indicia on said pouch and said tail, said indicia aligned along said user's index finger when the index finger points straight forward to accurately place the dentifrice carrying pad at the proper location on the user's index finger when said pouch is properly mounted on said user's index finger and said tail is wrapped around said thumb or a wrist of said user.

9. A dental appliance as claimed in claim 8 wherein said tail is an elastic material.

10. A dental appliance as claimed in claim 8 wherein the dentifrice carrying pad defines a plurality of bumps or ridges and said dentifrice is dry powder.

11. A dental appliance as claimed in claim 8 wherein said elongated tail has a plurality of thumb holes to accommodate different sizes of user's hands.

12. A dental appliance as claimed in claim 11 wherein the dentifrice carrying pad defines a plurality of bumps or ridges.

13. A dental appliance as claimed in claim 12 wherein said pouch has a massage pad outboard of said opposite fingernail surface of said user's finger.

14. A dental appliance as claimed in claim 13 wherein said massage pad carries additional dentifrice.

* * * * *